US006588151B1

(12) United States Patent
Goscicki et al.

(10) Patent No.: US 6,588,151 B1
(45) Date of Patent: Jul. 8, 2003

(54) POWER CLOSURE CONTROL APPARATUS

(75) Inventors: John T. Goscicki, Sterling Heights, MI (US); Anthony J. Sciarrotta, Eastpointe, MI (US); Steven J. Sabol, Macomb, MI (US); Gordon L. Cook, Flint, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/032,164

(22) Filed: Dec. 21, 2001

(51) Int. Cl.[7] ..... E05F 11/24
(52) U.S. Cl. ..... 49/340; 296/56
(58) Field of Search ..... 49/339, 340, 137; 296/146.8, 56; 200/47

(56) References Cited

U.S. PATENT DOCUMENTS 3,825,809 A * 7/1974 Gatland et al. ..... 200/47
5,851,049 A * 12/1998 Squire et al. ..... 296/146.8
6,318,795 B1 * 11/2001 Pyo ..... 296/146.8
6,382,706 B2 * 5/2002 Yuge et al. ..... 296/146.8
6,398,288 B1 * 6/2002 Yuge ..... 296/146.8
6,418,667 B1 * 7/2002 Moon ..... 49/340

* cited by examiner

*Primary Examiner*—Jerry Redman
(74) *Attorney, Agent, or Firm*—Kathryn A. Marra

(57) ABSTRACT

A power closure control apparatus including a power operator for moving a panel along a travel path. There is also included a pinch strip that is in communication with the power operator. The pinch strip includes a lower portion mounted to the vehicle and an upper portion that is movably engaged with the lower portion. A spring mechanism is disposed between the upper and lower portions to maintain a positional relationship between the upper and lower portions. The upper portion has a first extended position and a second retracted position such that when a force is applied to the upper portion it moves to its second retracted position thereby causing the power operator to cease moving the panel along the travel path.

19 Claims, 2 Drawing Sheets

POWER CLOSURE CONTROL APPARATUS

FIELD OF THE INVENTION

The subject invention relates to power closure control apparatuses on a vehicle, and more particularly to a power closure control apparatus that includes a pinch strip movable from a first to a second position thereby causing a power operator to cease moving a panel along a travel path.

BACKGROUND OF THE INVENTION

Sport utility vehicles and mini-vans have seen increased use with automobile consumers. Typically, such vehicles are equipped with a lift gate or other sliding panel to allow ingress and egress of passengers and/or cargo.

Due to the relatively heavy weight of such a movable panel, motorized panels including lift gates and power sliding doors have seen increased use with such vehicles.

Power operators are utilized for opening and closing panels such as a lift gate or a power sliding door. The power operators typically include a motor, clutch, and gear mechanism that moves the panel along a pre-determined path.

Various control mechanisms have been devised to control the travel of a panel along the path and to prevent damage to a power operating system due to the presence of an obstruction in the path of the panel. It is known in the art to utilize control mechanisms that measure the speed of the panel as a function of time and compare it to a predetermined value to determine if the panel encounters an obstruction. Such control mechanisms require the use of complex control that require expensive components.

It is also known in the art to utilize a hydraulic closure system that provides the power to operate a rear vehicle lift gate. The gate is lifted by the hydraulic actuators under pressure from a hydraulic pump. As with the control that measures the speed as a function of time, hydraulic systems require complex control mechanisms, as well as costly components.

There is therefore a need in the art for a power closure control apparatus that detects when an obstruction is within the travel path of a power operated panel. Such a power closure control apparatus should be easily assembled in the manufacturing process and provide a cost-effective control apparatus.

SUMMARY OF THE INVENTION

A power closure control apparatus that includes a power operator for moving a panel along a travel path. The power closure control apparatus includes a pinch strip that is in communication with the power operator. The pinch strip includes a lower portion that is mounted to the vehicle, and an upper portion that is movably engaged with the lower portion. A spring mechanism is disposed between and interacts with the upper and lower portions. The upper portion has a first extended position and a second retracted position. When a force is applied to the upper portion it moves from the first position to the second retracted position and causes the power operator to cease moving the panel along the travel path.

The power closure control apparatus of the present invention has the advantage of providing a cost-effective means for detecting whether an obstruction is in the travel path of a moving panel.

The power closure control apparatus of the present invention has the further advantage of providing a pinch strip that is spring-loaded such that the pinch strip may be retracted within a channel on a vehicle such that the pinch strip does not interfere with a sealing of the panel relative to the vehicle.

The power closure control apparatus has the further advantage of providing a pinch strip that may be located around a lift gate opening, in a region of a gas strut of the lift gate, such that the pinch strip retracts into a channel from an interaction with the gas strut.

BRIEF DESCRIPTION OF THE DRAWINGS

These and other features and advantages of the present invention will become more readily appreciated when considered in connection with the following detailed description and appended drawings, where.

DETAILED DESCRIPTION OF THE INVENTION

Figure 2:
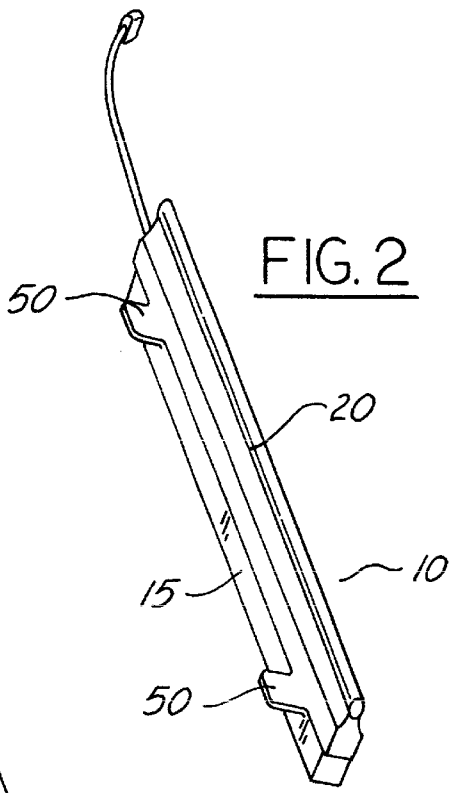
FIG. 2 is a perspective view of the pinch strip having tabs extending therefrom of a first embodiment of the present invention.
Figure 1:
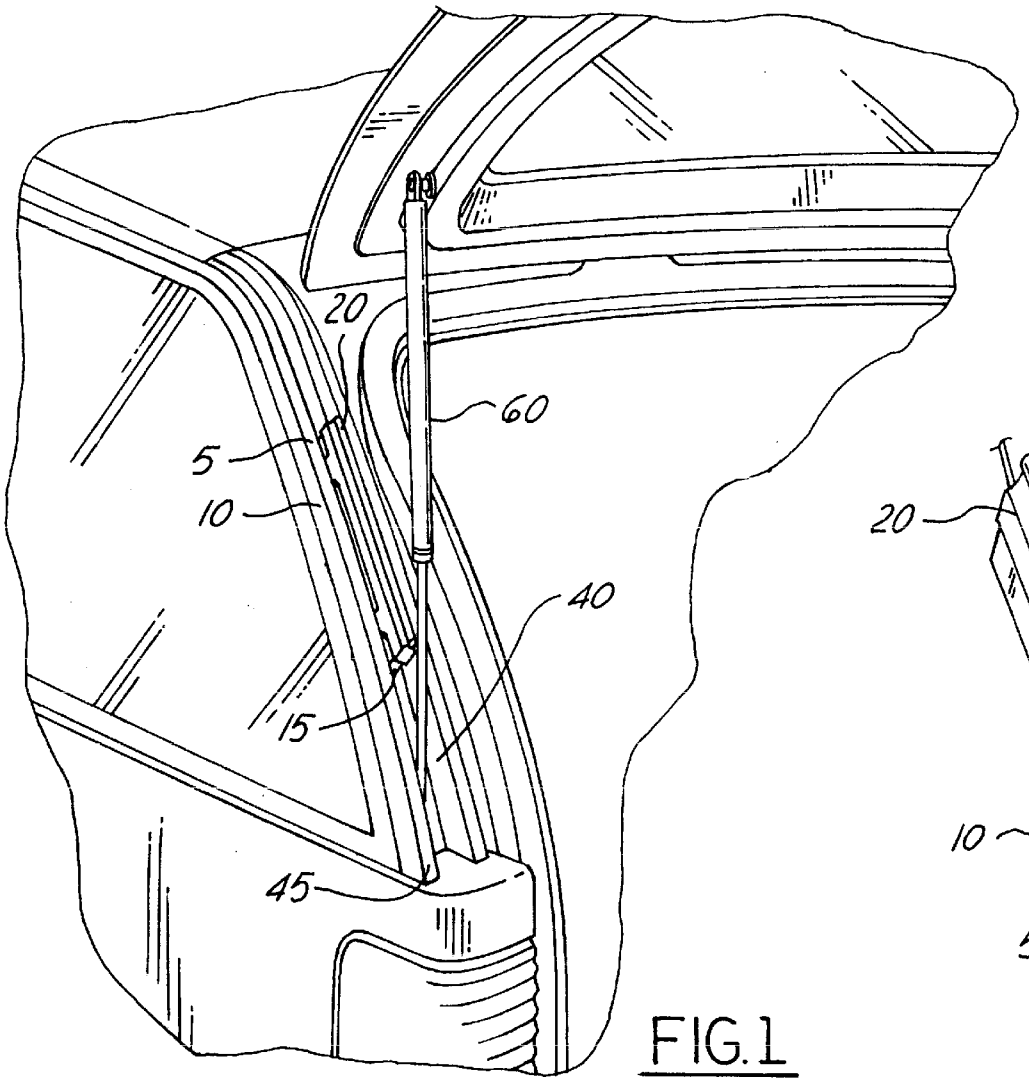
FIG. 1 is an environmental view detailing the power closure control apparatus mounted around a lift gate open.

With reference to FIGS. 1 and 2, there is shown the power closure control apparatus 5 of the present invention. The power closure control apparatus 5 includes a power operator (not shown) for moving a panel along a travel path. There is also included a pinch strip 10 in communication with the power operator. The pinch strip 10 includes a lower portion 15 that is mounted to the vehicle. There is also included an upper portion 20 that is movably engaged with the lower portion 15. A spring mechanism 25 is disposed between and interacts with the upper and lower portions 15, 20 for maintaining a spatial relationship of the upper 20 and lower 15 portions.

Figure 5:
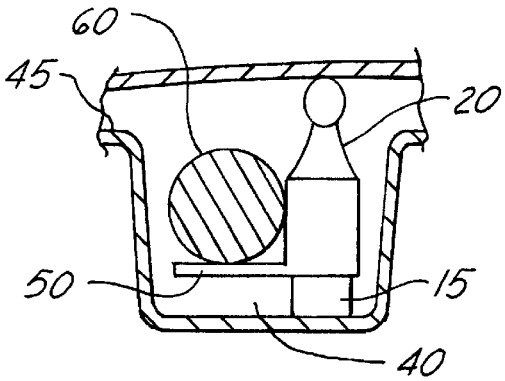
FIG. 5 is a sectional view of the pinch strip and lift gate in the retracted position.
Figure 6:
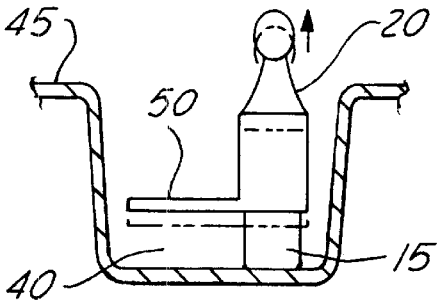
FIG. 6 is a sectional view detailing the pinch strip moving to its extended position.

The upper portion 20 has a first extended position shown in solid line in FIG. 6 and a second retracted position shown in solid line in FIG. 5. When a force is applied to the upper portion 20, the upper portion 20 moves from the first extended position of FIG. 6 to the second retracted position of FIG. 5 causing the power operator to cease moving the panel along the travel path.

With reference to FIG. 2, there is shown a first embodiment of the power closure control apparatus 5 wherein the pinch strip 10 includes tabs 50 extending from the upper portion 20 of the pinch strip 10. In this first embodiment, the lower portion 15 of the pinch strip 10 is preferably mounted within a channel 40 on a vehicle.

With reference to FIG. 1, there is shown in an environmental view in which the pinch strip 10 of the first embodiment is mounted within a channel 40 surrounding a lift gate of a motor vehicle. The pinch strip 10 and channel 40 are sized such that the upper portion 20 of the pinch strip 10 extends above a top surface 45 of the channel 40 when the upper portion 20 is in the first extended position shown in FIG. 6. In this manner, the power closure control apparatus 5 may detect the presence of an obstruction that contacts the upper portion 20 of the pinch strip 10.

Again with reference to FIG. 1, the pinch strip 10 of the first embodiment having tabs 50 is preferably positioned within the channel 40 in juxtaposition to a gas strut 60. The position of the pinch strip 10 of the first embodiment with relation to the gas strut 60 allows for detection of an obstruction that is placed between the gas strut 60 and the lift gate opening.

Figure 4:
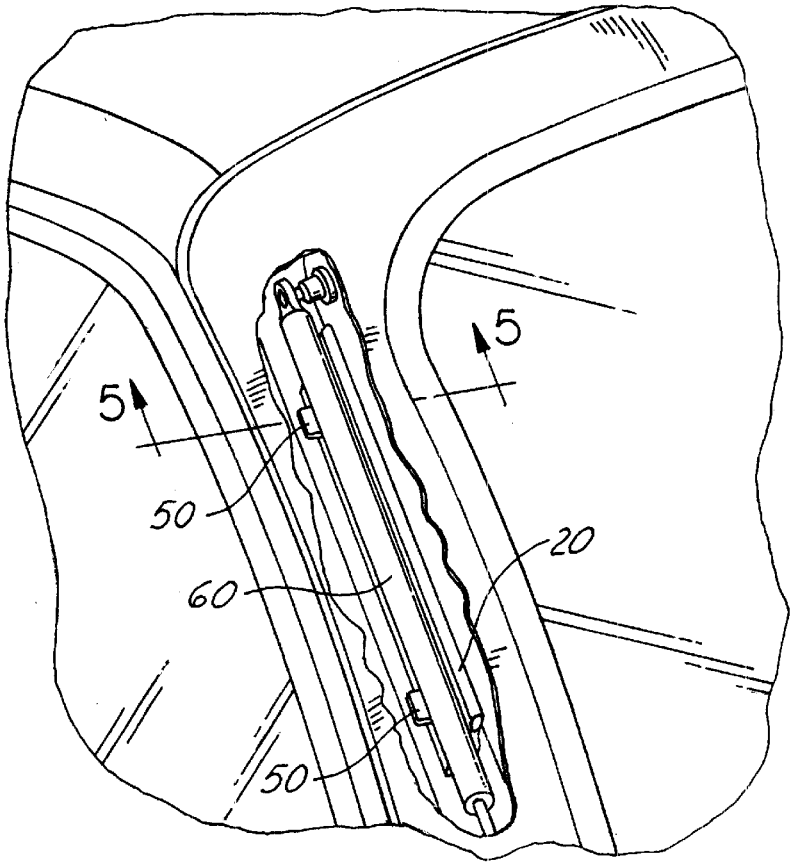
FIG. 4 is an environmental view of the pinch strip and gas strut of the lift gate in a retracted position.

With reference to FIG. 4, it can be seen that when the lift gate is closed, the gas strut 60 contacts the tabs 50 of the upper portion 20 thereby moving the upper portion 20 to the second retracted position shown in FIG. 5. In this manner, the upper portion 20 retracts to allow for the gas strut 60 to nest with the pinch strip 10 within the channel 40. In this manner, pinch strip 10 does not interfere with a sealing of the lift gate when it is in a closed position.

With reference to FIG. 5, there is shown a sectional view including the pinch strip 10 positioned within the channel 40. The gas strut 60 engages the tab 50, thereby moving the upper portion 20 to the second retracted position. As can be seen, the gas strut 60 is below the top surface 45 of the channel for storage of the gas strut 60 when the lift gate is closed.

With reference to FIG. 6, it can be seen that when a force is removed from the upper portion 20 of the pinch strip 10, the upper portion 20 moves in the direction of the arrow due to the presence of the spring mechanism 25.

Figure 3:
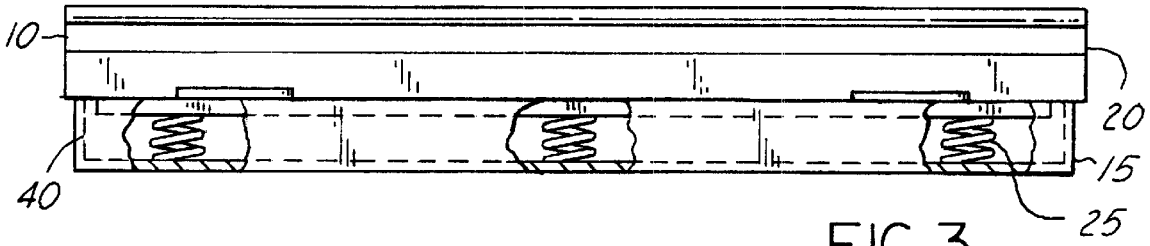
FIG. 3 is a side sectional view of the pinch strip located in a channel all around a lift gate open.

With reference to FIG. 3, there is shown a side sectional view of the power closure control apparatus 5 of the present invention. As can be seen, the pinch strip 10 is mounted in a channel 40. The upper portion 20 of the pinch strip 10 is positioned relative to the bottom portion 15 by the spring mechanism 25. The spring mechanism allows the upper portion 20 to be moved downwardly into the channel 40 when a sufficient force is applied to compress the springs 25. The upper portion 20 of the power strip 10 is therefore retractable into the channel 40 such that it does not interfere with a sealing engagement of a panel and a vehicle.

Figure 7:
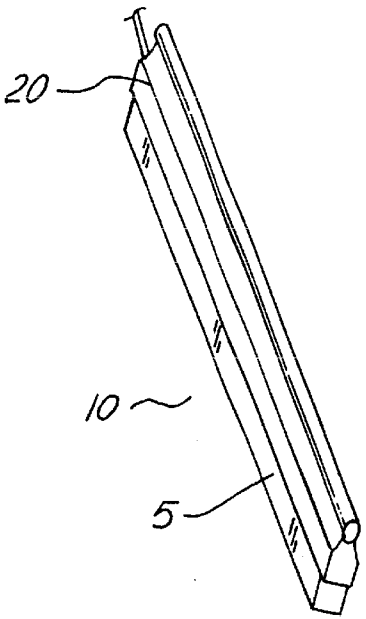
FIG. 7 is a perspective view of an alternative embodiment of the pinch strip without the tabs extending from the upper portion.

With reference to FIG. 7, there is shown a second embodiment of the present invention. The second embodiment is similar to that of the first embodiment except that it does not include the tabs 50 formed on the upper portion 20 of the pinch strip 10. In all other regards, the pinch strip 10 is identical to that of the first embodiment.

Similar to the first embodiment, the second embodiment is preferably mounted on a vehicle to detect the presence of an obstruction when a power operator is utilized. It is to be noted that the first and second embodiments of the present invention have been described in reference to a lift gate of a vehicle. It is, however, to be understood that the power closure control apparatus 5 of the present invention may be utilized in other power operator applications such as power deck lids, power sliding doors, power operated hood or any other power operated body panels associated with a vehicle.

In use, the pinch strip 10 is preferably mounted within a channel 40 on a motor vehicle. In the preferred embodiment, the channel surrounds a lift gate opening of a motor vehicle. Due to the presence of the spring mechanism 25 disposed between the upper portion 20 and lower portion 25 of the pinch strip 10, the upper portion 20 extends above the top surface 45 of the channel 40 when the pinch strip 10 is in its first position.

When a power operator is activated to close a panel, the power operator applies a force to move the panel along a travel path. If an obstruction is present, the upper portion 20 will be retracted to the second position, thereby stopping the power operator. In this manner, the power operator is protected from abusive loading and damage due to the presence of an obstruction, and a user is protected from inadvertent closure of the panel on a body part.

While a preferred embodiment is disclosed, a worker in this art would understand that various modifications would come within the scope of the invention. Thus, the following claims should be studied to determine the true scope and content of this invention.

What is claimed is:

1. A power closure control apparatus comprising:

a power operator for moving a panel along a travel path;

a pinch strip in communication with the power operator, the pinch strip comprising:

a lower portion mounted to a vehicle;

an upper portion moveably engaged with the lower portion; and a spring mechanism disposed between and interacting with the upper and lower portions;

the upper portion having a first extended position and a second retracted position, such that when a force is applied to the upper portion it moves to the second retracted position thereby causing the power operator to cease moving the panel along the travel path.

2. The power closure control apparatus of claim 1 wherein the lower portion is mounted within a channel on the vehicle.

3. The power closure control apparatus of claim 2 wherein the upper portion extends above a top surface of the channel when the upper portion is in the first extended position.

4. The power closure control apparatus of claim 3 wherein the upper portion further includes tabs extending therefrom.

5. The power closure control apparatus of claim 4 wherein the tabs extend perpendicular from the upper portion.

6. The power closure control apparatus of claim 4 wherein the lower portion is mounted within a channel surrounding a lift gate of a vehicle.

7. The power closure control apparatus of claim 6 wherein the lift gate includes a gas strut for facilitating opening and closing of the lift gate.

8. The power closure control apparatus of claim 7 wherein the gas strut contacts the tabs of the upper portion as the lift gate is closed thereby moving the upper portion to the second position.

9. The power closure control apparatus of claim 8 wherein the upper portion is below the top surface of the channel when the upper portion is in the second position.

10. A pinch strip assembly comprising:

a housing having upper and lower portions moveably interconnected;

a spring mechanism connected to the upper and lower portions for maintaining a positional relationship of the upper and lower portions;

the pinch strip being adapted to be mounted on a vehicle wherein the upper portion has a first extended position and a second retracted position, such that when a force is applied to the upper portion it moves to the second retracted position thereby causing a power operator to cease moving a panel along a travel path.

11. The pinch strip of claim 10 wherein the lower portion is mounted within a channel on the vehicle upon which the pinch strip is adapted to be mounted.

12. The pinch strip of claim 11 wherein the upper portion extends above a top surface of the channel when the upper portion is in the first extended position.

13. The pinch strip of claim 12 wherein the upper portion further includes tabs extending therefrom.

14. The pinch strip of claim 13 wherein the tabs extend perpendicular from the upper portion.

15. The pinch strip of claim 13 wherein the lower portion is mounted within a channel surrounding a lift gate of the vehicle upon which the pinch strip is adapted to be mounted.

16. The pinch strip of claim 15 wherein the lift gate includes a gas strut for facilitating opening and closing of the lift gate.

17. The pinch strip of claim 16 wherein the gas strut contacts the tabs of the upper portion as the lift gate is closed thereby moving the upper portion to the second position.

18. The pinch strip of claim 17 wherein the upper portion is below the top surface of the channel when the upper portion is in the second position.

19. A power closure control apparatus comprising:

a power operator for moving a panel along a travel path;

a pinch strip in communication with the power operator, the pinch strip comprising:

a lower portion mounted within a channel on a vehicle;

an upper portion moveably engaged with the lower portion; and a spring mechanism disposed between and interacting with the upper and lower portions;

the upper portion having a first extended position wherein the upper portion extends above a top surface of the channel and a second retracted position, such that when a force is applied to the upper portion it moves to the second retracted position thereby causing the power operator to cease moving the panel along the travel path.

* * * * *